US008925337B2

(12) United States Patent
Poux et al.

(10) Patent No.: US 8,925,337 B2
(45) Date of Patent: Jan. 6, 2015

(54) AIR CONDITIONING SYSTEMS AND METHODS HAVING FREE-COOLING PUMP-PROTECTION SEQUENCES

(75) Inventors: Damien Poux, Lyons (FR); Jean-Philippe Goux, Toussieu (FR); Joseph Ballet, Bressolles (FR)

(73) Assignee: Carrier Corporation, Farmington, CT (US)

( * ) Notice: Subject to any disclaimer, the term of this patent is extended or adjusted under 35 U.S.C. 154(b) by 932 days.

(21) Appl. No.: 12/520,825

(22) PCT Filed: Dec. 22, 2006

(86) PCT No.: PCT/US2006/048842
§ 371 (c)(1),
(2), (4) Date: Jun. 22, 2009

(87) PCT Pub. No.: WO2008/079116
PCT Pub. Date: Jul. 3, 2008

(65) Prior Publication Data

US 2010/0050669 A1 Mar. 4, 2010

(51) Int. Cl.

| | |
|---|---|
| ***F25B 1/00*** | (2006.01) |
| ***F25B 49/00*** | (2006.01) |
| ***F25D 17/02*** | (2006.01) |
| ***F25D 11/00*** | (2006.01) |
| ***F25B 41/00*** | (2006.01) |
| ***F25B 25/00*** | (2006.01) |
| ***F04D 15/02*** | (2006.01) |

(52) U.S. Cl.
CPC ..... *F25B 25/00* (2013.01); *F25B 2700/19* (2013.01); *F25B 2700/195* (2013.01); *F25B 41/00* (2013.01); *F25B 2400/0401* (2013.01); *F04D 15/0209* (2013.01)
USPC ..... 62/228.3; 62/99; 62/228.5; 62/430

(58) Field of Classification Search
USPC ..... 62/99, 228.3, 228.5, 430, DIG. 22
See application file for complete search history.

(56) References Cited

U.S. PATENT DOCUMENTS 2,718,766 A * 9/1955 Imperatore et al. ..... 62/79
4,108,574 A 8/1978 Bartley et al.

(Continued)

FOREIGN PATENT DOCUMENTS

| | | |
|---|---|---|
| CA | 2298373 A1 | 8/2011 |
| EP | 1286056 A1 | 2/2003 |
| WO | WO2006010202 A1 | 2/2006 |

OTHER PUBLICATIONS

Extended European Search Report and Supplementary European Search Report and European Search Opinion for International Application No. PCT/US2006048842, Mar. 28, 2012, 6 pages.

*Primary Examiner* — Alexandra Elve
*Assistant Examiner* — Daniel C Comings
(74) *Attorney, Agent, or Firm* — Cantor Colburn LLP

(57) ABSTRACT

An air conditioning system having a cooling mode and a free-cooling mode is provided. The system includes a refrigeration circuit, two pressure sensors, a controller, and a pump-protection sequence resident on the controller. The refrigeration circuit includes a compressor and a pump. The first pressure sensor is at an inlet of the pump, while the second pressure sensor is at an outlet of the pump. The controller selectively operates in the cooling mode by circulating and compressing a refrigerant through the refrigeration circuit via the compressor or operates in the free-cooling mode by circulating the refrigerant through the refrigeration circuit via the pump: The pump-protection sequence turns the pump to an off state based at least upon a differential pressure determined by the controller from pressures detected by the first and second pressure sensors.

13 Claims, 2 Drawing Sheets

(56) References Cited

U.S. PATENT DOCUMENTS 4,640,100 A 2/1987 Goldstein
5,884,493 A * 3/1999 Karstrom et al. ..... 62/99
6,038,879 A * 3/2000 Turcotte et al. ..... 62/325
6,076,367 A * 6/2000 Sandofsky et al. ..... 62/209
2004/0065099 A1 4/2004 Grabon et al.

* cited by examiner

AIR CONDITIONING SYSTEMS AND METHODS HAVING FREE-COOLING PUMP-PROTECTION SEQUENCES

BACKGROUND OF THE INVENTION

1. Field of the Invention

The present disclosure is related to air conditioning systems. More particularly, the present disclosure is related to methods and systems for controlling air conditioning systems having a free-cooling mode and a cooling mode.

2. Description of Related Art

During the typical operation of air conditioning systems, the system is run in a cooling mode wherein energy is expended by operating a compressor. The compressor to compresses and circulates a refrigerant to chill or condition a working fluid, such as air or other secondary loop fluid (e.g., chilled water or glycol), in a known manner. The conditioned working fluid can then be used in a refrigerator, a freezer, a building, an automobile, and other spaces with climate controlled environment.

However, when the outside ambient temperature is low, there exists the possibility that the outside ambient air itself may be utilized to provide cooling to the working fluid without engaging the compressor. When the outside ambient air is used by an air conditioning system to condition the working fluid, the system is referred to as operating in a free-cooling mode.

As noted above, traditionally, even when the ambient outside air temperature is low, the air conditioning system is run in the cooling mode. Running in cooling mode under such conditions provides a low efficiency means of conditioning the working fluid. In contrast, running the air conditioning system under such conditions in a free-cooling mode is more efficient. In the free-cooling mode, one or more ventilated heat exchangers and pumps are activated so that the refrigerant is circulated by the pumps and is cooled by the outside ambient air. In this manner, the refrigerant, cooled by the outside ambient air, can be used to cool the working fluid without the need for the low efficiency compressor.

Accordingly, it has been determined by the present disclosure that there is a need for methods and systems that improve the efficiency of air conditioning systems having a free cooling mode.

BRIEF SUMMARY OF THE INVENTION

Air conditioning systems and methods of controlling are provided that, when operating in free-cooling mode, include a pump-protection sequence based at least upon a differential pressure across the pump.

An air conditioning system having a cooling mode and a free-cooling mode is provided. The system includes a refrigeration circuit, two pressure sensors, a controller, and a pump-protection sequence resident on the controller. The refrigeration circuit includes a compressor and a pump. The first pressure sensor is at an inlet of the pump, while the second pressure sensor is at an outlet of the pump. The controller selectively operates in the cooling mode by circulating and compressing a refrigerant through the refrigeration circuit via the compressor or operates in the free-cooling mode by circulating the refrigerant through the refrigeration circuit via the pump. The pump-protection sequence turns the pump to an off state based at least upon a differential pressure determined by the controller from pressures detected by the first and second pressure sensors.

A method of controlling an air conditioning system having a cooling mode and a free-cooling mode is also provided. The method includes switching the air conditioning system to the free-cooling mode and determining whether to maintain the air conditioning system in the free-cooling mode with a refrigerant pump in an on state or whether to switch the air conditioning system to the free-cooling mode with the refrigerant pump in an off state based at least upon a pressure differential across the refrigerant pump.

The above-described and other features and advantages of the present disclosure will be appreciated and understood by those skilled in the art from the following detailed description, drawings, and appended claims.

DETAILED DESCRIPTION OF THE INVENTION

Figure 1:
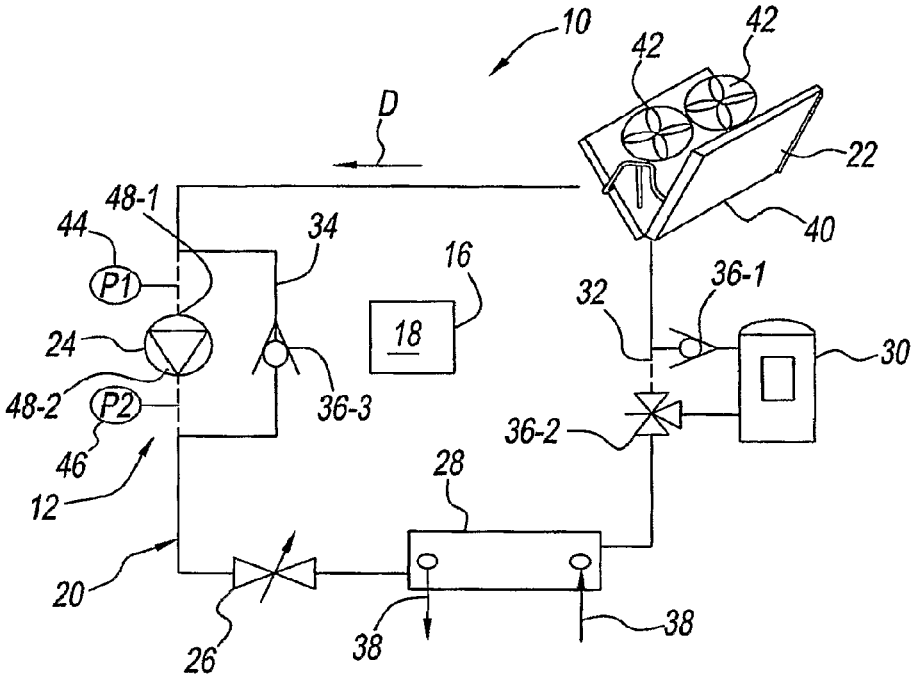
FIG. 1 is an exemplary embodiment of an air conditioning system in cooling mode according to the present disclosure.
Figure 2:
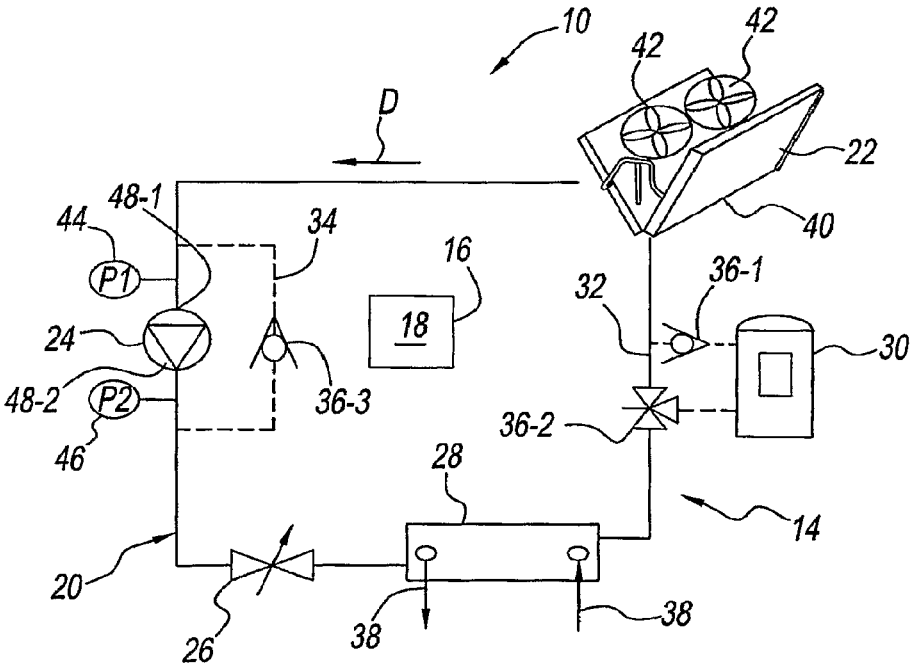
FIG. 2 is an exemplary embodiment of an air conditioning system in free-cooling mode according to the present disclosure.

Referring now to the drawings and in particular to FIGS. 1 and 2, an exemplary embodiment of an air conditioning system ("system") according to the present disclosure, generally referred to by reference numeral 10, is shown. System 10 is configured to operate in a cooling mode 12 (FIG. 1) and a free-cooling mode 14 (FIG. 2).

System 10 includes a controller 16 for selectively switching between cooling and free-cooling modes 12, 14. Advantageously, controller 16 includes a pump-protection sequence 18 resident thereon that monitors pressure in system 10 when operating in free-cooling mode 14 to mitigate instances of pump cavitation. In this manner, system 10 improves pump reliability during free-cooling mode 14 as compared to prior art systems.

System 10 also includes a refrigeration circuit 20 that includes a condenser 22, a pump 24, an expansion device 26, an evaporator 28, and a compressor 30. Controller 16 is configured to selectively control either compressor 30 (when in cooling mode 12) or pump 24 (when in free-cooling mode 14) to circulate a refrigerant through system 10 in a flow direction (D). Thus, system 10, when cooling mode 12, controls compressor 30 to compress and circulate the refrigerant in flow direction D. However, system 10, when in free-cooling mode 14, controls pump 24 to circulate the refrigerant in flow direction D. As such, the free-cooling mode 14 uses less energy then cooling mode 12 since the free-cooling mode does not require the energy expended by compressor 30.

System 10 includes a compressor by-pass loop 32 and a pump by-pass loop 34. System 10 includes one or more valves 36-2 controlled by controller 16 and one or more mechanical check valves 36-1 and 36-3. In this manner, controller 16 can selectively position valves 36-2 to selectively open and close by-pass loop 32, while check valves 36-1 and 36-3 avoid flow of refrigerant in an undesired direction.

In cooling mode 12, controller 16 controls valve 36-2 so that compressor by-pass loop 32 is closed, where check valve 36-3 is opened by the flow of refrigerant so that pump by-pass loop 34 is opened. In this manner, system 10 is configured to allow compressor 30 to compress and circulate refrigerant in the flow direction D by flowing through pump by-pass loop 34.

In contrast, controller 16, when in free-cooling mode 14, controls valve 36-2 so that compressor by-pass loop 32 is open, where check valve 36-1 is maintained closed by the flow of refrigerant. In this manner, system 10 is configured to allow pump 24 to circulate refrigerant in the flow direction D by flowing through compressor by-pass loop 32.

Accordingly, system 10 can condition (i.e., cool and/or dehumidify) a working fluid 38 in heat-exchange communication with evaporator 28 in both cooling and free cooling modes 12, 14. Working fluid 38 can be ambient indoor air or a secondary loop fluid such as, but not limited to chilled water or glycol.

In cooling mode 12, system 10 operates as a standard vapor-compression air conditioning system known in the art where the compression and expansion of refrigerant via expansion device 26 are used to condition working fluid 38. Expansion device 26 can be any known expansion device such as, but not limited to, fixed expansion device (e.g., an orifice) or a controllable expansion device (e.g., a thermal expansion valve). In the example where expansion device 26 is a controllable expansion device, the expansion device is preferably controlled by controller 16.

In free-cooling mode 14, system 10 uses takes advantage of the heat removing capacity of outdoor ambient air 40, which is in heat exchange relationship with condenser 22 via one or more fans 42, to condition working fluid 38.

Although system 10 is described herein as a conventional air conditioning (cooling) system, one skilled in the art will recognize that 10 may also be configured as a heat pump system to provide both heating and cooling, by adding a reversing valve (not shown) so that condenser 22 (i.e., the outdoor heat exchanger) functions as an evaporator in the heating mode and evaporator 28 (i.e., the indoor heat exchanger) functions as a condenser in the heating mode.

It has been determined by the present disclosure that refrigerant leaving condenser 22, even during operation in free-cooling mode 14, can be in one of several different phases, namely a gas phase, a liquid-gas phase, or a liquid phase. Thus, pump 24 can be supplied with refrigerant in the different phases when operating in free-cooling mode 14.

Unfortunately, when pump 24 is supplied with refrigerant the gas or liquid-gas phases, the pump does not operate as desired. Moreover, the gas phase and/or liquid-gas phase refrigerant can cause pump 24 to cavitate and/or diffuse, which can damage the pump and/or the pump motor (not shown).

For example, system 10, when running in free-cooling mode 14, may experience events such as system malfunctions, refrigerant leaks, and other conditions that can effect the phase of the refrigerant in refrigeration circuit 20 between condenser 22 and expansion device 26 that may cause pump 24 to cavitate (e.g., liquid-gas phase refrigerant) or to defuse (e.g., gas phase refrigerant). If these states of pump 24 are not detected, there is a risk of pump damage.

Advantageously, controller 16 includes pump-protection sequence 18 that detects cavitation and/or defusing in pump 24 when the pump is running (i.e., during operation in free-cooling mode 14). Thus, controller 16 continuously monitors pump 24, during free cooling mode 14, in such a manner to detect pump abnormalities.

System 10 includes a first pressure sensor 44 and a second pressure sensor 46 in electrical communication with controller 16. First pressure sensor 44 is positioned at an entrance 48-1 of pump 24, while second pressure sensor 46 is positioned at an exit 48-2 of the pump. Controller 16 uses the pressures measured by first and second sensors 44, 46 to continuously determine a pump pressure differential.

Figure 3:
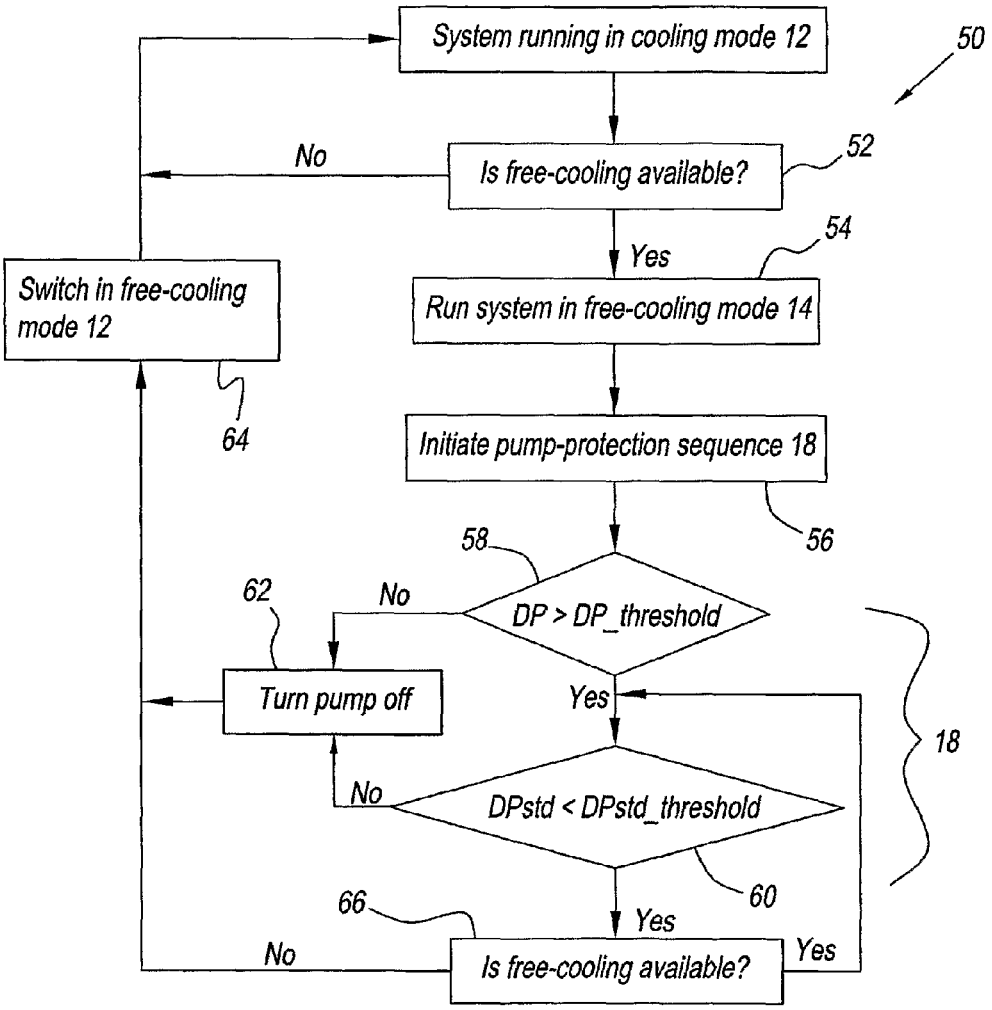
FIG. 3 illustrates an exemplary embodiment of a method of operating the air conditioning system of FIGS. 1 and 2 according to the present disclosure.

The operation of pump-protection sequence 18 is described in more detail with reference to FIG. 3. FIG. 3 illustrates an exemplary embodiment of a method 50 of controlling system 10 having pump-protection sequence 18, as well as an exemplary embodiment of the pump-protection sequence according to the present disclosure.

Method 50, when system 10 is operating in cooling mode 12, includes a first free cooling determination step 52. During first free cooling determination step 52, method 50 determines whether the temperature of ambient air 40 is sufficient for system 10 to switch to free-cooling mode 14. If free cooling is available, method 50 switches and runs system 10 into free cooling mode 14 at a switching step 54, which results in pump 24 being turned on. If free cooling is not available, method 50 continues to operate system 10 in cooling mode 12.

It should be recognized that method 50 is described herein by way of example in use while system 10 is operating in cooling mode 12. Of course, it is contemplated by the present disclosure for method 50 to find equal use when system 10 is stopped such that pump-protection sequence 18 avoids pump cavitation during start-up of system 10 into free-cooling mode 14 from a stopped state.

After free-cooling switching step 54, method 50 includes a pump initiation step 56, where method 50 initiates pump-protection sequence 18. Once initiated, pump-protection sequence 18 includes a first comparison step 58 and a second comparison step 60.

First comparison step 58 compares the pump differential pressure (DP) to a predetermined minimum differential pressure threshold (DP_threshold). As used herein, the pump differential pressure (DP) is the difference of the pressures measured by first and second sensors 44, 46. The minimum DP_threshold is based, at least in part, on the size of the pump 24. For example, the minimum DP_threshold can be set at about 35 kiloPascals (kPa) for a small refrigerant pump or about 70 kPa for a big refrigerant pump.

At the start of sequence 18, namely during first comparison step 58, controller 16 turns pump 24 to an on state for a first predetermined period of time. First comparison step 58 then compares the differential pressure (DP) to the minimum DP_threshold. After the comparison, controller 16 stops pump 24 for a second predetermined period of time.

The cycle (i.e., running pump 24 for the first period of time, the comparison, and stopping the pump for the second period of time) is repeated by first comparison step 58 in the following manner. In an exemplary embodiment, the first predetermined period of time is about 10 seconds and the second predetermined period of time is about 4 seconds such that each cycle is about 14 seconds.

When first comparison step 58 determines that the minimum DP_threshold has been established, pump 24 is considered to be in an amorced or primed state. However, when first comparison step 58 determines that the minimum DP_threshold has not been established, pump 24 is considered to be in a cavitating state.

If first comparison step 58 determines that pump 24 is not primed or amorced after a first predetermined number of cycles, then sequence 18 proceeds to pump shut down step 62 and switches system 10 back to cooling mode 12 at a cooling mode switching step 64. Here, pump 24 is considered to be in the cavitating state. In an exemplary embodiment, the first predetermined number of cycles can be about 25 cycles.

If first comparison step 58 determines that pump 24 is primed or amorced for a second predetermined number of cycles, then sequence 18 proceeds leaves pump 24 in the "on" state and continues to second comparison step 60. Here, pump 24 is considered to be in the primed state. In an exemplary embodiment, the first predetermined number of cycles can be about 4 cycles (e.g., about 56 seconds).

Second comparison step 60 compares the standard deviation average of the pump differential pressure (DPstd) to a predetermined standard deviation average differential pressure threshold (DPstd_threshold). The DPstd_threshold is also based, at least in part, on the size of the pump 24. For example, the DPstd_threshold can be set at about 35 kilopascals (kPa) for a small refrigerant pump or about 70 kPa for a big refrigerant pump.

Second comparison step 60 is implemented to avoid pump defusing during free-cooling mode 14.

If DPstd is less than DPstd_threshold for a third predetermined period of time at second comparison step 60, then system 10 continues to operate in free-cooling mode 14. Here, pump 24 is considered to be in the primed state. In an exemplary embodiment, the third predetermined period of time is about 30 seconds.

However, if DPstd is greater than DPstd_threshold at second comparison step 60, then sequence 18 turns pump 24 to the "off" state at pump shut down step 62 and switches system 10 back to cooling mode 12 at a cooling mode switching step 64. Here, pump 24 is considered to be in a defusing state.

If, after completing pump-protection state 18, system 10 remains in free-cooling mode 14, method 50 also includes a second free cooling determination step 66. During second free cooling determination step 66, method 50 again determines whether the temperature of ambient air 40 is sufficient for system 10 to remain in free-cooling mode 14. If free cooling is available, method 50 maintains system 10 in free cooling mode 14. If free cooling is not available, method 50 switches system 10 back into cooling mode 12 at cooling mode switching step 64.

In this manner, sequence 18 is configured to continuously monitor the differential pressure at pump 24 to and is configured to turn the pump off when the refrigerant in refrigeration circuit 20 is presented to the pump in the gas phase and/or the liquid-gas phase.

Accordingly, system 10 and method 50 of the present disclosure having pump-protection sequence 18 can be used to protect pump 24 from damage during operation in free-cooling mode 14. As such, system 10 and method 50 of the present disclosure prevent damage to pump 24 due to cavitation and defusing in the pump.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. An air conditioning system having a cooling mode and a free-cooling mode, comprising:

a refrigeration circuit have a compressor and a pump;

a first pressure sensor at an inlet of said pump;

a second pressure sensor at an outlet of said pump;

a controller for selectively operating in the cooling mode by circulating and compressing a refrigerant through said refrigeration circuit via said compressor or operating in the free-cooling mode by circulating said refrigerant through said refrigeration circuit via said pump; and a pump-protection sequence resident on said controller, said pump-protection sequence turning said pump to an off state based at least upon a differential pressure determined by said controller from pressures detected by said first and second pressure sensors;

wherein said pump-protection sequence turns said pump to said off state based upon a comparison of an standard deviation average of differential pressure to a predetermined standard deviation average threshold.

2. The air conditioning system as in claim 1, wherein said refrigeration circuit further comprises an evaporator in heat exchange communication with said refrigerant and a working fluid.

3. The air conditioning system as in claim 2, wherein said working fluid comprises ambient indoor air.

4. The air conditioning system as in claim 2, wherein said working fluid comprises a secondary loop fluid.

5. The air conditioning system as in claim 1, wherein said refrigeration circuit further comprises an expansion device.

6. The air conditioning system as in claim 5, wherein said expansion device is a fixed expansion device.

7. The air conditioning system as in claim 5, wherein said expansion device is a controllable expansion device.

8. The air conditioning system as in claim 7, wherein said controllable expansion device is controlled by said controller.

9. A method of controlling an air conditioning system having a cooling mode and a free-cooling mode, the method comprising:

switching the air conditioning system to the free-cooling mode; and determining whether to maintain the air conditioning system in the free-cooling mode with a refrigerant pump in an on state or whether to switch the air conditioning system to the cooling mode with said refrigerant pump in an off state based at least upon a pressure differential across said refrigerant pump wherein said determining comprises comparing said pressure differential to a threshold-pressure;

wherein said determining further comprises:

maintaining the air conditioning system in the free-cooling mode with said refrigerant pump in said on state if said pressure differential is greater than said threshold pressure; and switching the air conditioning system to the cooling mode with said refrigerant pump in said off state if said pressure differential is less than said threshold pressure.

10. The method as in claim 9, wherein said determining comprises comparing an average standard deviation of said pressure differential to an average standard deviation threshold.

11. The method as in claim 10, wherein said determining further comprises:

maintaining the air conditioning system in the free-cooling mode with said refrigerant pump in said on state if said average standard deviation is less than said average standard deviation threshold; and switching the air conditioning system to the cooling mode with said refrigerant pump in said off state if average standard deviation is greater than said average standard deviation threshold.

12. A method of controlling an air conditioning system having a cooling mode and a free-cooling mode, the method comprising:

switching the air conditioning system to the free-cooling mode; and determining whether to maintain the air conditioning system in the free-cooling mode with a refrigerant pump in an on state or whether to switch the air conditioning system to the cooling mode with said refrigerant pump in an off state based at least upon a pressure differential across said refrigerant pump;

wherein said determining comprises comparing an average standard deviation of said pressure differential to an average standard deviation threshold.

13. The method as in claim 12, wherein said determining further comprises:

maintaining the air conditioning system in the free-cooling mode with said refrigerant pump in said on state if said average standard deviation is less than said average standard deviation threshold; and switching the air conditioning system to the cooling mode with said refrigerant pump in said off state if average standard deviation is greater than said average standard deviation threshold.

* * * * *